United States Patent [19]

Harrison, Sr.

[11] 4,198,729

[45] Apr. 22, 1980

[54] CARD CYLINDER SHROUD, FLAT MOUNTING AND BEARING ASSEMBLY

[75] Inventor: John E. Harrison, Sr., Greenville, S.C.

[73] Assignee: John D. Hollingsworth on Wheels, Inc., Greenville, S.C.

[21] Appl. No.: 824,288

[22] Filed: Aug. 15, 1977

[51] Int. Cl.[2] ..... D01G 15/02; D01G 15/12; D01G 15/32

[52] U.S. Cl. ..... 19/98; 19/105

[58] Field of Search ..... 19/98, 104, 103, 102, 19/105

[56] References Cited

U.S. PATENT DOCUMENTS 4,549,986 6/1891 Platt et al. ..... 19/105 X

FOREIGN PATENT DOCUMENTS 423652 2/1935 United Kingdom ..... 19/103

973960 11/1964 United Kingdom ..... 19/98

*Primary Examiner*—Louis Rimrodt

*Attorney, Agent, or Firm*—Bailey, Dority & Flint

[57] ABSTRACT

An assembly is illustrated for use in connection with a main cylinder and the like wherein an annular shroud has a segmental portion of reduced thickness for providing a ledge type bearing surface for support and securement directly to a frame, the shroud also having a bearing receiving recess so that the cylinder mounting shaft may be supported within the shroud. The bearing has a pair of parallel inserts, spaced on each side of the shaft, having thickened inner portions for engaging the inner race of the bearing for removing the bearing while the cylinder is carried within the frame. The shroud provides an arcuate mounting surface for positioning stationary card flats facilitating the provision of means for resiliently carrying the flats yieldably urging them downwardly while permitting adjustment of the settings.

3 Claims, 7 Drawing Figures

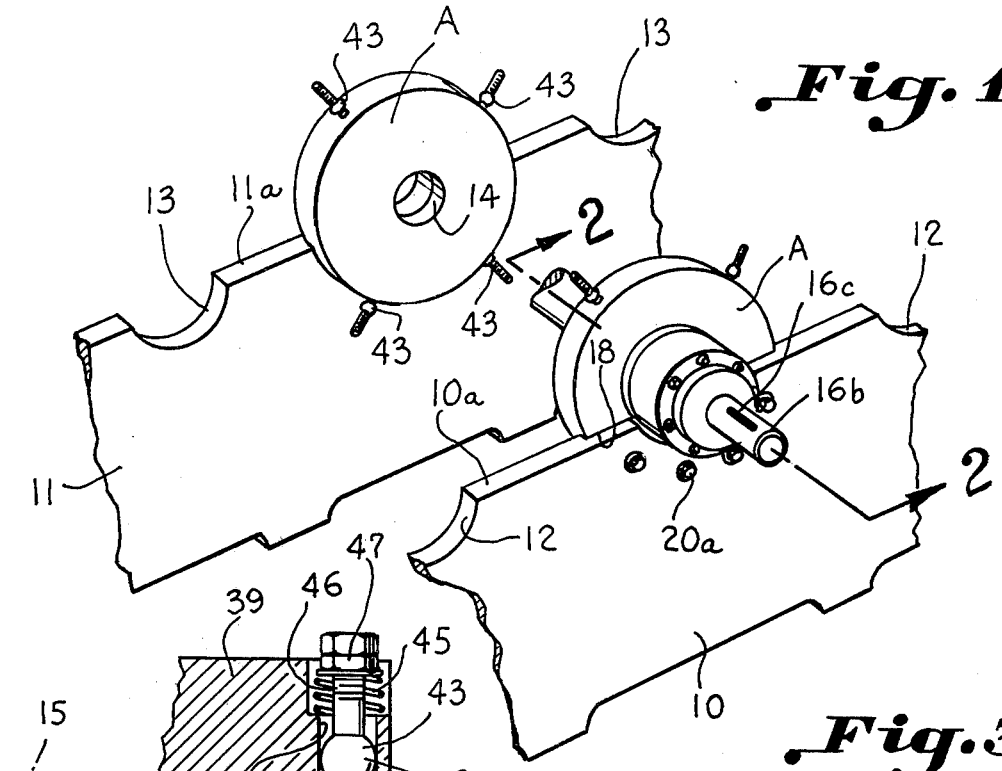
Fig. 1.
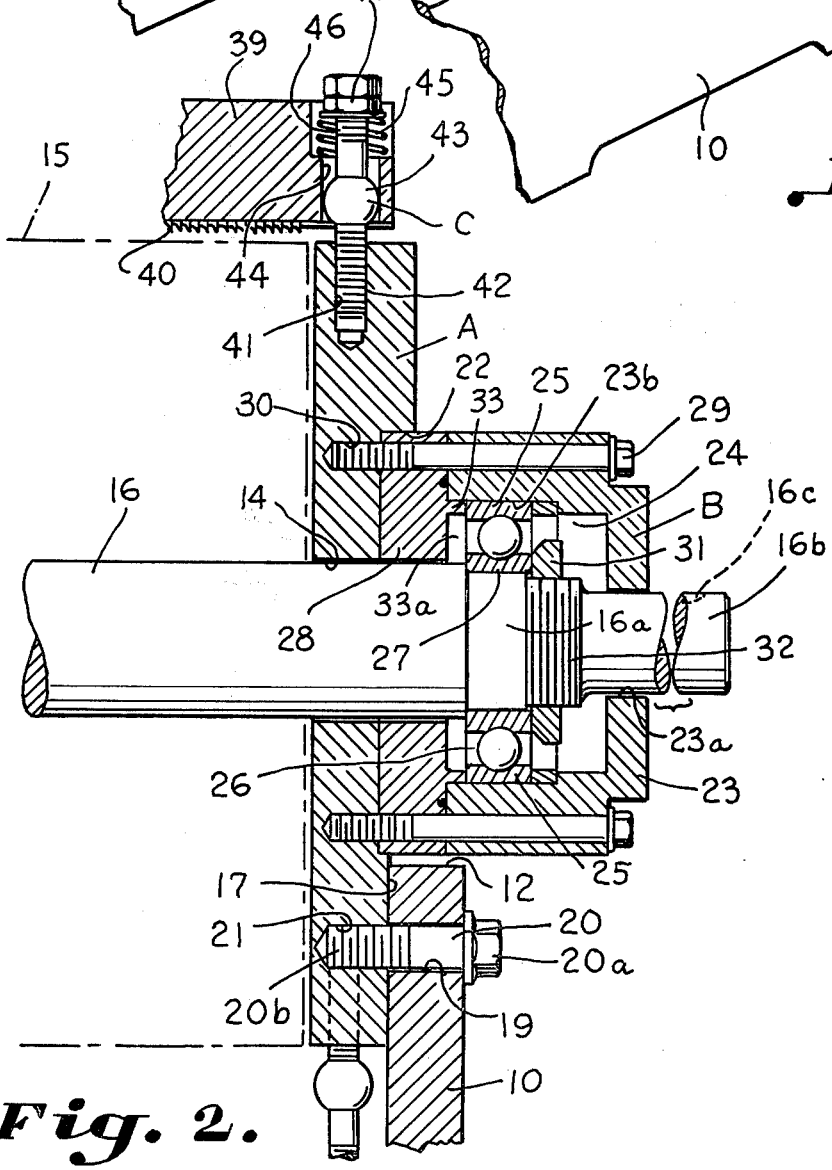
Fig. 2.
Fig. 3.
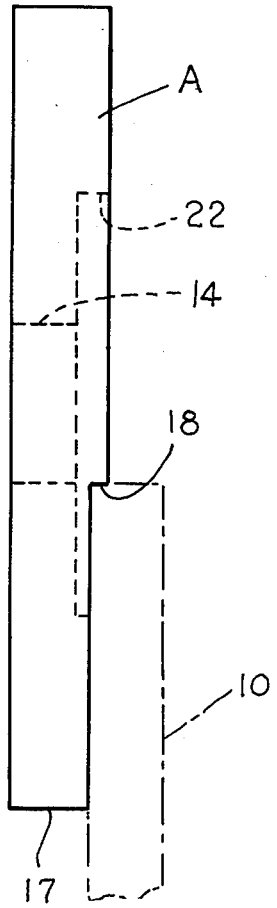

CARD CYLINDER SHROUD, FLAT MOUNTING AND BEARING ASSEMBLY

BACKGROUND OF THE INVENTION

It is common practice for the mounting shafts of the main cylinder of a carding machine and the like to be carried in pillow block bearings on the arch of the card. When removing the main cylinder from the card, it is necessary to first disassemble the flats and then disassemble the pillow block bearings. Such a practice is time consuming because the card settings are lost and it is necessary that the bearing itself be removed. A variation of this practice is illustrated in U.S. Pat. No. 3,597,801 wherein the bearing is provided with pivoted means for insuring axial alignment of the bearing on the cylinder shaft. Pedestal supports for bearing blocks carrying a card cylinder are illustrated in U.S. Pat. No. 2,665,954.

The removal of the inner race of a rolling bearing assembly such as ball or roller bearings has always presented a problem in that external pulling means which engage the outer race of the bearing, are normally employed. The force necessary to overcome the attachment of the inner race to the shaft often results in spalding of the ball or roller bearings themselves or other injury to the assembly. One of the objects of the present invention is to provide a means for removing bearing assemblies from a shaft without the necessity of exerting a pulling force against the outer race of the bearing. In the case of a bearing for the cylinder shaft of a carding machine, it is especially desirable that the bearing be removable without disengaging or removing the cylinder from its position within the card frame members.

Stationary card flats of the type illustrated in U.S. Pat. No. 3,604,062 and 3,604,475 are rigidly secured to the arch of the card and settings are made utilizing various shimming type arrangements. The difficulty here is that the settings are generally lost when for any reason the stationary flats are removed and the rigid mounting resists the passage of foreign objects between the clothing of the cylinder and the clothing of the flats thus causing damage to either or both sets of card clothing.

Accordingly, it is an important object of this invention to provide a secure mounting for fixing the cylinder shafts of a carding machine with respect to the frame so that in the event of failure of the bearing, the cylinder will remain firmly secured in its place between the card frame members. By providing a secure mounting increase in cylinder speed is safely made possible.

Another important object of the invention is to provide a mounting for a card cylinder utilizing a shroud assembly which permits removal of the cylinder and flat assemblies at the same time as a unit without disturbing the settings thereof.

Another important object of the invention is to provide a means for removing bearings from a shaft in such a manner that the removing force may be exerted upon the inner race of the bearing, minimizing any tendency to spalding of the balls or other damage to the assembly.

Still another important object of the invention is to provide a shroud arrangement for use with the main cylinder of a card which provides a mounting for securement of stationary flats in any of the customary positions and which permits the positioning of flats, plates or other members entirely about the cylinder in such a way that the flats may be resiliently and yieldably carried with means for positively securing any desired settings.

Since the cylinder shafts are always surrounded by the ledge supported shroud the enormous forces generated by the massive cylinder or other carding rollers may be safely contained at high speeds.

BRIEF DESCRIPTION OF THE INVENTION

A card cylinder shroud, flat mounting and bearing assembly is provided wherein an arcuate shroud is equipped with a shelf-type mountng surface, the entire assembly including the cylinder being removable as a unit from the card frame member. The shroud internally carries a bearing arrangement independently of the frame and which provides a peripheral arcuate surface facilitating the mounting of card flats in a yieldable fashion with positive means for securing settings. The bearing has spaced inserts carried on each side of the cylinder shaft with thickened portions or projections engaging the inner race of the bearing independently of the outer race facilitating removal of the bearing from the shaft without damage to the bearing.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view with parts omitted illustrating a card cylinder shroud flat mounting and bearing assembly constructed in accordance with the present invention positioned between the side frame members of a multicylinder card, FIG. 2 is an enlarged transverse sectional elevation taken on the line 2—2 in FIG. 1, FIG. 3 is a side elevation illustrating a shroud such as shown in FIG. 1 positioned upon a side frame member, the side frame member being shown in broken lines.

DESCRIPTION OF A PREFERRED EMBODIMENT

Figure 4:
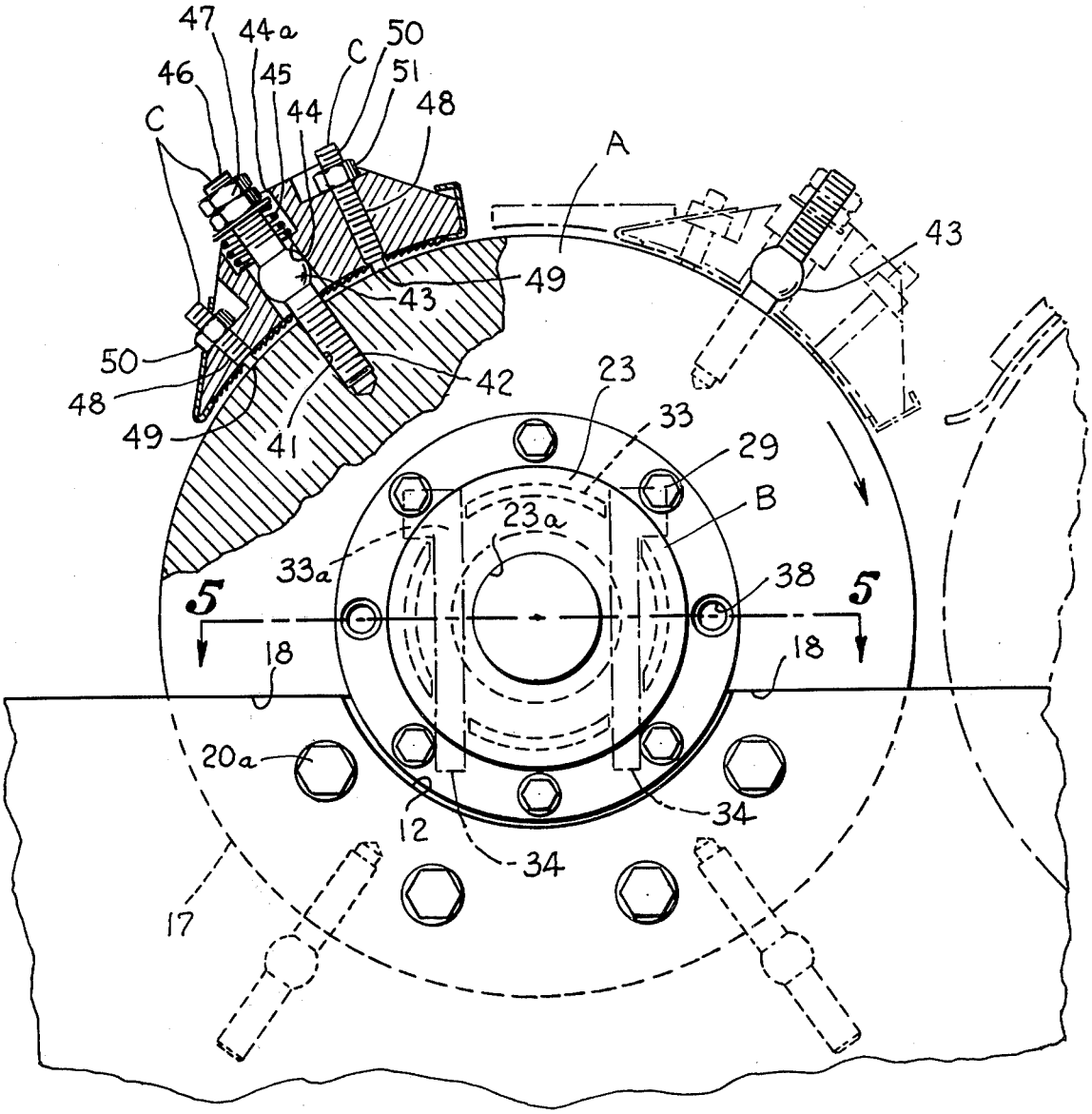
FIG. 4 is a front elevation further illustrating the shroud and associated parts shown in FIG. 2.
Figure 6:
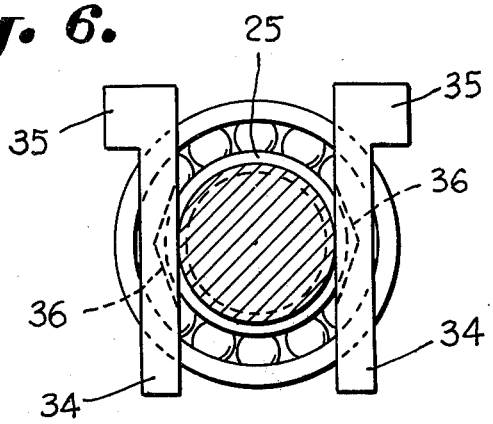
FIG. 6 is a sectional front elevation taken on the line 6—6 in FIG. 5 further illustrating the spaced bearing removing inserts.
Figure 7:
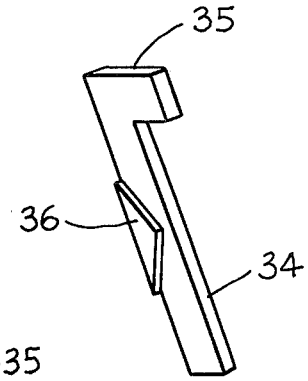
FIG. 7 is a perspective view illustrating the thickened portion of one of the bearing removing inserts.

The drawings illustrate a shroud arrangement with associated parts utilized and connected with a multicylinder carding arrangement. The invention contemplates however, that application thereof may be had to more conventional carding arrangements and any other variations thereof as well including rolls other than main cylinders.

The carding machine has a pair of spaced side frame members 10 and 11, each of which carries opposed arcuate cutout portions 12 and 13 which are transversely aligned with each other for accommodating the bearings in spaced relation thereto. The fibrous stock may be fed to and from the cylinder in any conventional manner or variation thereof. For purposes of illustration, a single cylinder or roll is illustrated having stationary flats and plates spaced about the periphery thereof.

The shroud is illustrated in the form of an annular member A having an internal bore 14 for receiving the cylinder mounting shafts. A clothed carding cylinder is illustrated schematically by broken lines at 15 carried between the stub shafts 16. The shroud has a segmental portion 17 of reduced thickness so as to define spaced ledge type surfaces 18 for bearing directly upon upper surfaces 10*a* and 11*a* of the side frame members. A plurality of spaced openings 19 are provided within the side frame members 10 and 11 for receiving a shank of a bolt 20 having a head 20*a* and a threaded portion 20*b* which is received by complimentary internally threaded openings 21 within the external surface of the shroud A. The shroud A further has a bearing receiving recess or housing 22 for accommodating the bearing B therein. The bearing B includes a bearing cap 23 which has a bore 23*a* for accommodating the driven shaft 16 and a cylindrical recess 24 for carrying in a seat 23*b* the outer race 25 of a ball bearing assembly having balls 26 supported by an inner race 27. The opposite cap need not have a bore adjacent the cylinder shaft which is not driven and in both instances lubricating means (not shown) for retaining lubricant may be utilized.

As illustrated in FIG. 2, a bearing base member or housing 28 is fitted within the annular recess 22 within the shroud and is secured therein by bolts 29 which are threadably received within the circumferentially spaced internally threaded bores 30 within the reduced bearing receiving portion of the shroud. The inner races 27 are carried upon the reduced portion 16*a* of the shaft 16 and are confined thereon by a fitting 31 threadably carried upon the shaft as illustrated at 32. A reduced end portion of the shaft 16 is illustrated at 16*b* and carries a keyway 16*c* for mounting a driving means for the cylinder.

Figure 5:
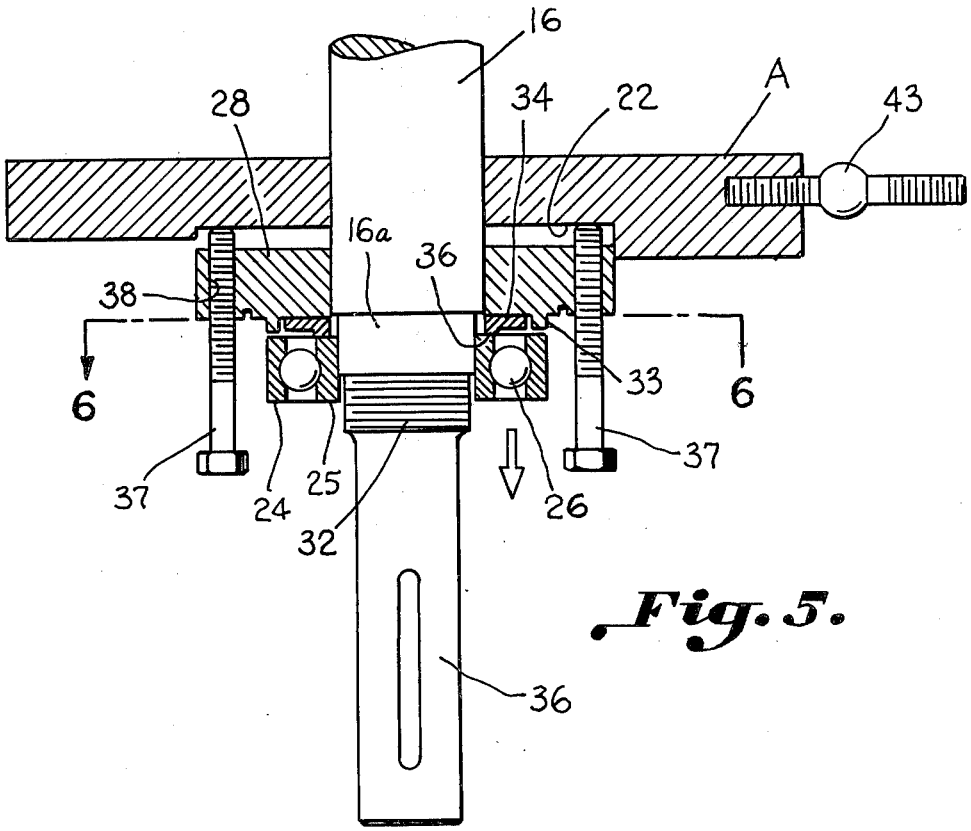
FIG. 5 is a sectional top plan view with the spaced bearing removing members inserted.

The base member 28 carries an arcuate outwardly facing rib 33 which has aligned spaces 33*a* forming a slot therein for receiving spaced inserts 34. The inserts 34 have a leg 35*a* and thickened edge portions are illustrated at 36. These projections engage the inner race of the bearing for removal thereof when inserted in the verticall slot formed by the spaces 33*a* after removal of the cap 33. It will be observed that the base member (see FIG. 5) may be urged outwardly by mechanical action of exerting a turning force upon the jack screws 37. The jack screws 37 are insertable into the internal threaded openings 38 carried within the base member 28 for this purpose and exert a separating force upon the shroud.

The stationary flats are carried by the outer periphery of the shroud and are illustrated as of the type shown and described in U.S. Pat. No. 3,604,475, FIGS. 2 and 4. The stationary flats include a plate 39 having metallic card clothing 40 on an arcuate interior surface thereof. The shroud has circumferentially spaced, threaded openings 41 therein for carrying a threaded shank 42 which forms a part of the flat mounting arrangement designated generally at C. The threaded shank carries an arcuate enlargement 43 which is slidably carried within an open bore 44, carried within an end portion of the card flats intermediate the sides thereof.

A coil spring 45 is fitted above and is shown to be in alignment with the arcuate pivotal members 43 within an enlarged portion 44*a* of the bore 44. A threaded shank 46 extends integrally from the arcuate member 43. Threaded nut means 47 are illustrated for varying the pressure upon the coil spring 45 thus varying the yieldable force with which the flats are urged against the rim of the shroud. Settings are facilitated by adjustment of a threaded shank 48 threadably carried on each side of the pivotal member 43. The threaded shanks 48 are threadably received within the flat plate 39 and have terminal bearing members 49 which may be urged into engagement with the outer periphery of the shroud by turning the shank portion 50 and upon the achievement of desired settings, nuts 51 may be securely positioned to insure retention of the desired setting. If desired, cover or other plates and the like may be so positioned in lieu of stationary flats and, if desired, conventional flats may be employed instead of the flat fastening arrangement described herein.

While a preferred embodiment of the invention has been described using specific terms, such description is for illustrative purposes only, and it is to be understood that changes and variations may be made with departing from the spirit or scope of the following claims.

What is claimed is:

1. A shroud for a clothed cylinder and the like carrying a pair of opposed shafts, one of said shafts projecting from each end of said cylinder for mounting the cylinder for rotation, and side frame members with a bearing receiving opening adjacent an upper portion of said side frame members, said shroud comprising:

an annular element having a recess therein for receiving one of said shafts;

said annular element having a segmental portion thereof of reduced thickness;

said recess surrounding said one of said shafts; and said portion of reduced thickness extending across said recess defining spaced ledge-like support surfaces on each side thereof of said recess for engagement with one of said side frame members.

2. The structure set forth in claim 1 wherein said recess includes a bore and a bearing receiving portion.

3. A carding machine and the like including:

a cylinder carrying a pair of opposed shaft portions projecting from each end of said cylinder for mounting the cylinder for rotation;

spaced side frame members with a bearing receiving opening adjacent an upper portion of each of said side frame members;

transversely spaced opposed elements each having a recess therein for receiving a shaft;

said elements each having a segmental portion thereof of reduced thickness;

said portions of reduced thickness each extending across said recess and each defining spaced ledge-like support surfaces on each side of respective recesses for engagement with a side frame member of said carding machine on each side of respective bearing openings; and means for fixedly securing each of said elements to respective side frame members in opposed relation to each other.

* * * * *